US008565381B2

(12) United States Patent
Sukowski et al.

(10) Patent No.: US 8,565,381 B2
(45) Date of Patent: Oct. 22, 2013

(54) RADIATION SOURCE AND METHOD FOR THE GENERATION OF X-RADIATION

(75) Inventors: Frank Sukowski, Postbauer-Heng (DE); Norman Uhlmann, Erlangen (DE)

(73) Assignee: Fraunhofer-Gesellschaft zur Förderung der angewandten Forschung e.V., München (DE)

( * ) Notice: Subject to any disclaimer, the term of this patent is extended or adjusted under 35 U.S.C. 154(b) by 410 days.

(21) Appl. No.: 12/996,239

(22) PCT Filed: May 28, 2009

(86) PCT No.: PCT/EP2009/003784

§ 371 (c)(1),
(2), (4) Date: Dec. 3, 2010

(87) PCT Pub. No.: WO2009/146827

PCT Pub. Date: Dec. 10, 2009

(65) Prior Publication Data

US 2011/0080997 A1 Apr. 7, 2011

(30) Foreign Application Priority Data

Jun. 5, 2008 (DE) ..... 10 2008 026 938

(51) Int. Cl.
*G21G 4/08* (2006.01)
*H01J 35/08* (2006.01)
*H05G 1/02* (2006.01)

(52) U.S. Cl.
USPC ..... 378/119; 378/143; 250/438

(58) Field of Classification Search
USPC ..... 378/119, 121, 140, 143, 193, 210; 250/370.01, 370.08, 370.09, 423 R, 250/427, 428, 432 R, 435–438
See application file for complete search history.

(56) References Cited

U.S. PATENT DOCUMENTS

| | | | | |
|---|---|---|---|---|
| 6,477,234 | B2 * | 11/2002 | Harding et al. | 378/141 |
| 6,560,313 | B1 * | 5/2003 | Harding et al. | 378/143 |
| 6,647,094 | B2 * | 11/2003 | Harding et al. | 378/143 |
| 6,925,151 | B2 * | 8/2005 | Harding et al. | 378/119 |
| 6,961,408 | B2 * | 11/2005 | Harding et al. | 378/143 |
| 7,127,036 | B2 * | 10/2006 | Harding et al. | 378/139 |
| 7,412,032 | B2 * | 8/2008 | Harding | 378/125 |
| 7,436,931 | B2 * | 10/2008 | Harding | 378/143 |
| 7,443,958 | B2 * | 10/2008 | Harding | 378/143 |
| 7,471,769 | B2 * | 12/2008 | Harding et al. | 378/143 |
| 2003/0016789 | A1 * | 1/2003 | Harding et al. | 378/143 |
| 2004/0174957 | A1 * | 9/2004 | Harding et al. | 378/143 |
| 2005/0175153 | A1 * | 8/2005 | Harding et al. | 378/143 |

FOREIGN PATENT DOCUMENTS

| | | | |
|---|---|---|---|
| DE | 101 29 463 | A1 | 1/2003 |
| EP | 0 239 882 | A1 | 10/1987 |
| WO | WO 02/11499 | A1 | 2/2002 |
| WO | WO 03/077276 | A1 | 9/2003 |

(Continued)

*Primary Examiner* — Anastasia Midkiff
(74) *Attorney, Agent, or Firm* — McGlew and Tuttle, P.C.

(57) ABSTRACT

In a radiation source and a method for the generation of X-radiation, a liquid is arranged in a liquid line, the liquid being completely surrounded by the liquid line in the direction of an evacuated chamber. A portion of the liquid line is permeable to an electron beam such that the electron beam extending through the chamber is able to enter via the liquid line so as to interact with the liquid in an interaction zone for the generation of X-radiation. The radiation source ensures a good dissipation of heat from the interaction zone and prevents liquid from entering the chamber.

19 Claims, 2 Drawing Sheets

(56) References Cited

FOREIGN PATENT DOCUMENTS

| | | | |
|---|---|---|---|
| WO | WO 03/077277 | A1 | 9/2003 |
| WO | WO 2005/096341 | A1 | 10/2005 |
| WO | WO 2005/101450 | A1 | 10/2005 |
| WO | WO 2005101450 | A1 * | 10/2005 |

* cited by examiner

RADIATION SOURCE AND METHOD FOR THE GENERATION OF X-RADIATION

CROSS REFERENCE TO RELATED APPLICATIONS

This application is a U.S. National Phase application of International Application PCT/EP2009/003784 and claims the benefit of priority under 35 U.S.C. §119 of German Patent Application DE 10 2008 026 938.7 filed Jun. 5, 2008, the entire contents of which are incorporated herein by reference.

FIELD OF THE INVENTION

The invention relates a radiation source for the generation of X-radiation. The invention further relates to a method for the generation of X-radiation.

BACKGROUND OF THE INVENTION

Non-destructive examination of objects by means of X-ray computer tomography requires the use of high-energy X-radiation sources which allow examination of objects that have high penetration lengths or high densities. In conventional X-radiation sources, the X-ray target is a solid body; under electron beam bombardment, a high temperature increase can be observed in the interaction zone, the so-called focal spot, of the solid body, which results in high thermal loads acting on the interaction zone. A dissipation of the heat generated in the focal spot of a solid body is very difficult. The achievable output power of the X-radiation is therefore limited due to the thermal load of the X-ray target. X-radiation sources with an X-radiation of high output power are however required in particular to achieve a good image quality at a short irradiation time.

WO 02/11 499 A1 discloses an X-radiation source where a liquid jet is used as X-ray target. The liquid jet is generated by means of a nozzle and collected by a suction pipe. Between the nozzle and the suction pipe, the liquid jet is able to move freely in an evacuated chamber. The liquid jet is bombarded with an electron beam in order to generate X-radiation. The X-ray target being designed as a liquid jet allows better dissipation of heat generated in the focal spot than a solid body. The achievable output power of the X-radiation is higher than compared to X-radiation sources using a solid body as X-ray target. A drawback is that in the event of an excessive temperature increase of the liquid jet, the vapor pressure of the liquid jet may increase such that complete removal thereof is impossible, causing a part of the liquid jet to evaporate and to deposit on the internal walls of the evacuated chamber. This impairs the functionality and reliability of the X-radiation source.

SUMMARY OF THE INVENTION

It is therefore the object of the invention to provide a radiation source for the generation of high-energy X-radiation which allows large amounts of heat to be dissipated from the interaction zone while ensuring full functionality and high reliability of the radiation source.

This object is achieved according to the invention by a radiation source for the generation of X-radiation, the radiation source comprising an evacuated chamber; an electron beam generation unit for the generation of an electron beam extending in the chamber in an electron beam direction; a target unit, the target unit comprising a liquid line with a liquid arranged therein, the liquid line extending transversely to the electron beam direction, with an interaction zone for the generation of X-radiation being generable by interaction of the electron beam and the liquid, with the liquid being completely surrounded by the liquid line in the direction of the chamber, and with at least a portion of the liquid line being permeable to the electron beam in such a way that the interaction zone is generable inside the liquid line. As the liquid acting as X-ray target is completely surrounded by the liquid line in the direction of the evacuable chamber, the liquid is entirely separated from the chamber, thus preventing liquid from escaping the liquid line and from depositing in the chamber. Heat dissipation from the interaction zone by means of the liquid jet is not impaired by the liquid line. At least the portion of the liquid line through which the electrons enter the liquid line is substantially permeable or transparent to the electron beam to keep the loss of kinetic energy of the electrons in the electron beam as low as possible when entering the liquid line. The permeable design prevents the electrons from interacting with the liquid line, allowing the electron beam to interact with the liquid in order to form the interaction zone without any loss of energy in the liquid line. Due to the liquid acting as X-ray target, the inventive radiation source thus allows a good dissipation of heat from the interaction zone while simultaneously preventing the escape of liquid from the liquid line to avoid an impaired functionality and reliability of the radiation source. If required, the electron beam generation unit may be operated at higher acceleration voltage, in particular at more than 500 kV, in particular at more than 1 MV, and in particular at more than 3 MV, causing a corresponding high-energy X-radiation to be generated which is preferably emitted in the electron beam direction. Suitable liquids are liquid metals such as mercury or liquids containing metal microparticles.

A development of the target unit where the target unit is designed such that the X-radiation is emissible substantially in the electron beam direction ensures easy generation of high-energy X-radiation. The liquid provided by means of the target unit serves as so-called transmission X-ray target. The generated X-radiation is substantially emitted in the electron beam direction. To this end, the side of the liquid line opposite to the electron beam permeable portion is X-ray permeable or transparent, allowing the X-radiation to exit the liquid line in the electron beam direction substantially without any loss of energy. When the acceleration voltage or energy of the electrons increases, the intensity relationship of X-radiation generated in the electron beam direction compared to X-radiation generated opposite to the electron beam direction increases as well. At higher acceleration voltages from approximately 1 MV, or high electron energies from approximately 1 MeV, the X-radiation is generated substantially in the electron beam direction, which is taken advantage of in the target unit. The liquid arranged in the liquid line thus forms a transmission X-ray target. The generation efficiency for high-energy X-radiation is much higher in the inventive transmission X-ray target than in a reflection X-ray target where the X-radiation is substantially generated opposite to the electron beam direction. The electron beam generation unit is therefore operable at an acceleration voltage of at least 500 kV, in particular of at least 1 MV, and in particular of at least 3 MV.

A liquid line where the permeable portion consists of a material of one or more chemical elements each having an atomic number of no more than 14 is most substantially permeable to the electrons of the electron beam. Permeability increases with decreasing atomic number of the chemical elements of the material. Suitable materials are for instance compounds of beryllium, carbon, oxygen, aluminum and/or silicon. A suitable material is for instance carbon in the shape of graphite or diamond. Other suitable materials are glassy compounds of carbon which are for instance available under the brand name Sigradur. These materials may be ceramics. In order to achieve a high permeability or transparency, it is important that all chemical elements of the material have an atomic number of no more than 14.

A material, which is at least one of the group comprising beryllium, diamond and aluminum, is both permeable and stable.

A design of the liquid line where the permeable portion of the liquid line has a dimension in the electron beam direction in the range of 10 μm to 1000 μm, in particular in the range of 20 μm to 800 μm, and in particular in the range of 50 μm to 500 μm increases the electron beam permeability. The smaller the dimension in the electron beam direction, the higher the permeability. The permeable portion of the liquid line simultaneously has a sufficient stability to accommodate the forces caused by the pressure difference between the pressures inside and outside the liquid line. As the stability also decreases with decreasing dimension in the electron beam direction, the dimension must be chosen such as to provide a sufficient permeability and stability of the permeable portion at the same time.

A design of the liquid line where the permeable portion of the liquid line has a dimension in a direction transverse to the electron beam direction of no more than 2000 μm, in particular of no more than 1000 μm, and in particular of no more than 500 μm increases the stability of the permeable portion. The smaller the dimension of the permeable portion in a direction transverse to the electron beam direction, the higher the stability thereof. The dimension of the permeable portion in the direction transverse to the electron beam direction is preferably no larger than the cross-section of the electron beam. A small dimension in the direction transverse to the electron beam direction is in particular possible if the target unit is designed for generation of the X-radiation in the electron beam direction with the liquid acting as transmission X-ray target as the generated X-radiation need not exit the liquid line again via the permeable portion.

A permeable portion in the form of an entrance window which is tightly arranged in a recess of a line wall of the liquid line is a simple way of providing a permeable portion of the liquid line. The entrance window and the remaining line wall of the liquid line may in particular be made of different materials. The entrance window and/or the line wall are preferably made of a heat and corrosion resistant material. The line wall preferably has a wall thickness in the range of 0.5 mm to 50 mm, in particular in the range of 1.0 mm to 20 mm, and in particular in the range of 2 mm to 10 mm. The line wall is formed on the side opposite to the entrance window in such a way as to provide for a substantially unattenuated escape of the generated X-radiation from the liquid line.

A design of the liquid line where the liquid line comprises a supply portion having a first inner cross-sectional surface and an impingement portion having a second inner cross-sectional surface, the impingement portion comprising the permeable portion of the liquid line, with a relationship of first inner cross-sectional surface to second inner cross-sectional surface being greater than 1, in particular greater than 10, and in particular greater than 100 minimizes the pressure difference between the evacuated chamber and the liquid at the site of the permeable portion of the liquid line or the entrance window. The reduced inner cross-sectional surface in the impingement portion results in an increased speed of the liquid flowing through said portion, causing the static pressure to reduce according to Bernoulli's equation. The transition portion between the supply portion and the impingement portion may principally taper to the extent required. The taper may be symmetrical in all directions or asymmetrical in at least one selected direction.

A transition portion extending in the shape of a funnel which is formed between the supply portion and the impingement portion prevents the formation of a turbulent flow.

Forming the liquid line with an impingement portion having an internal dimension of no more than 5000 μm, in particular of no more than 1000 μm, and in particular of no more than 100 μm along the electron beam direction allows the size of the interaction zone referred to as focal spot to be kept small. The smaller the internal dimension of the impingement portion, the smaller the focal spot. The smaller the focal spot, the higher the achievable image quality.

A liquid pump of the target unit improves the dissipation of heat from the interaction zone. The pressure and speed of the liquid in the liquid line are adjustable by means of the liquid pump.

A cooling unit of the target unit for cooling the liquid allows the temperature of the liquid to be kept at a constant level at all times. The liquid is pumped through a heat exchanger serving as cooling unit preferably after the electron beam bombardment.

A liquid which consists of a material of one or more chemical elements each having an atomic number of at least 50 ensures a good relation between the generation of X-radiation and the generation of heat. This relation improves with increasing atomic number of the chemical elements of the liquid. Using mercury as the liquid proved to be suitable in practical application for generating X-radiation.

An X-ray computer tomograph comprising a radiation source according to the invention allows examination of objects having high penetration lengths and/or high densities while ensuring a good image quality.

Another object of the invention is to provide a method for the generation of high-energy X-radiation which allows large amounts of heat to be dissipated from the interaction zone while ensuring full functionality and high reliability of the radiation source.

This object is achieved according to the invention by a method for the generation of X-radiation, the method comprising the steps of generating an electron beam extending in an evacuated chamber in an electron beam direction; guiding a liquid, which is completely surrounded by a liquid line in the direction of the chamber, through the chamber in a direction transverse to the electron beam direction; introducing the electron beam into the liquid via at least one portion of the liquid line which is permeable to the electron beam; and generating an interaction zone inside the liquid line where the electron beam interacts with the liquid for the generation of X-radiation. The advantages of the inventive method correspond to the advantages of the inventive radiation source described above.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
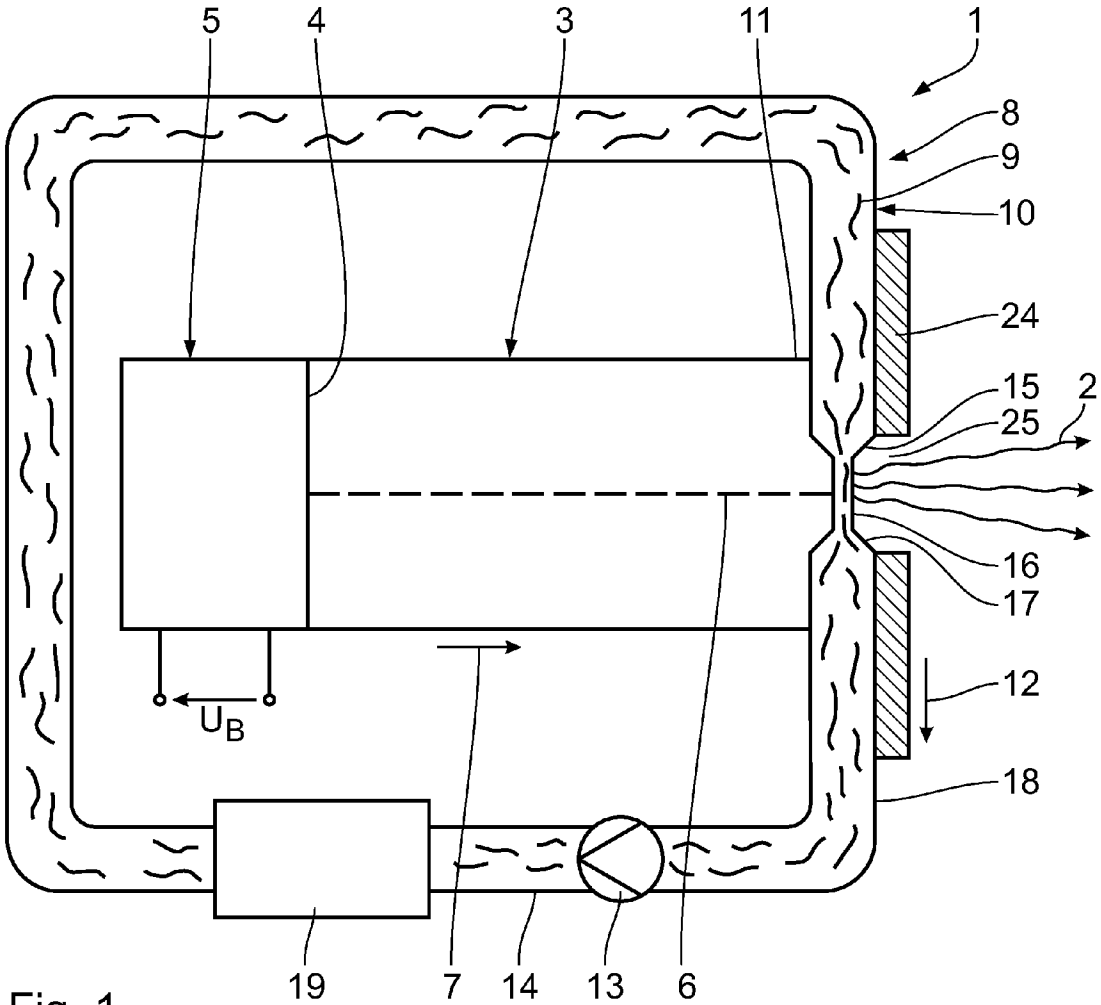
FIG. 1 is a schematic illustration of a radiation source for the generation of X-radiation with a liquid arranged in a liquid line, the liquid acting as X-ray target.

A radiation source 1 comprises an evacuated chamber 3 for the generation of high-energy X-radiation 2. An electron beam generation unit 5 is arranged at a first end 4 of the evacuated chamber 3. The electron beam generation unit 5 serves for the generation of an electron beam 6 extending along the chamber 3 in an electron beam direction 7. In order to accelerate the electrons forming the electron beam 6, the electron beam generation unit 5 is operable at a maximum acceleration voltage $U_B$ of 160 kV to 24 MV, in particular of 500 kV to 24 MV, in particular of 1 MV to 24 MV, and in particular of 3 MV to 24 MV. Alternatively, the upper limit for the acceleration voltage may amount to 18 MV. The electron beam generation unit 5 is a linear accelerator (LINAC) where the electrons are generable by thermionic emission and are accelerable in several steps in an evacuated tube, the so-called waveguide. At lower acceleration voltages $U_B$, the electron beam generation unit 5 may alternatively be an X-ray tube.

The radiation source 1 comprises a target unit 8 which serves to provide an X-ray target 9. The X-ray target 9 is a liquid and is hereinafter referred to as liquid 9.

The liquid 9 is arranged in a closed liquid line 10 which extends transversely to the electron beam direction 7 at a second end 11 of the chamber 3 and seals the chamber 3. The liquid 9 is thus completely surrounded by the liquid line 10 in the direction of the chamber 3.

The target unit 8 comprises a liquid pump 13 causing the liquid 9 to flow in a flow direction 12. Starting from the liquid pump 13, the liquid line 10 is divided into a supply portion 14, a first transition portion 15 which tapers in the shape of a funnel, an impingement portion 16, a second transition portion 17 which expands in the shape of a funnel, and a discharge portion 18. The impingement portion 16 is arranged centrally at the second end 11 of the chamber 3, causing the electron beam 6 to hit the liquid line 10 in the impingement portion 16. In the supply portion 14, a cooling unit 19 in the form of a heat exchanger is arranged in the liquid line 10 for cooling the liquid 9.

In the impingement portion 16, a portion 20 of the liquid line 10 is permeable or transparent to the electron beam 6 in such a way that the electron beam 6 is able to enter the liquid line 10 via the permeable portion 20 substantially without any loss of kinetic energy. The permeable portion 20 of the liquid line 10 is a separate entrance window which is tightly arranged in a recess 21 of a line wall 22 forming the liquid line 10. By interaction of the electron beam 6 and the liquid 9, an interaction zone 23 referred to as focal spot is generable in the liquid line 10 for generation of the X-radiation 2. The permeable portion of the liquid line 10 is hereinafter referred to as entrance window 20.

The entrance window 20 consists of a material of one or more chemical elements each having an atomic number of no more than 14. The material of the entrance window 20 is preferably beryllium, diamond or aluminum. These materials have a high permeability to the electron beam 6 due to their atomic numbers. The line wall 22 may principally be made of any desired material which need in particular not be permeable to the electron beam 6.

The entrance window 20 has a dimension D of no more than 1000 μm, in particular of no more than 100 μm, and in particular of no more than 10 μm in the electron beam direction 7. The smaller the thickness dimension D, the higher the transparency of the entrance window 20 for the electron beam 6. If the dimension D of the entrance window 20 does not exceed 1000 μm, then the dimension D is preferably in the range of 10 μm to 1000 μm, in particular in the range of 20 μm to 800 μm, and in particular in the range of 50 μm to 500 μm, which at the same time ensures a high stability of the entrance window 20.

Transversely to the electron beam direction 7, the entrance window 20 has a dimension H of no more than 2000 μm, in particular of no more than 1000 μm, and in particular of no more than 500 μm. The entrance window 20 may be in the shape of a circle or a square. If the entrance window 20 is circular, the dimension H refers to the diameter. If the entrance window 20 is square-shaped, the dimension H refers to the side length.

The dimension H preferably corresponds to the diameter of the electron beam 6.

Figure 2:
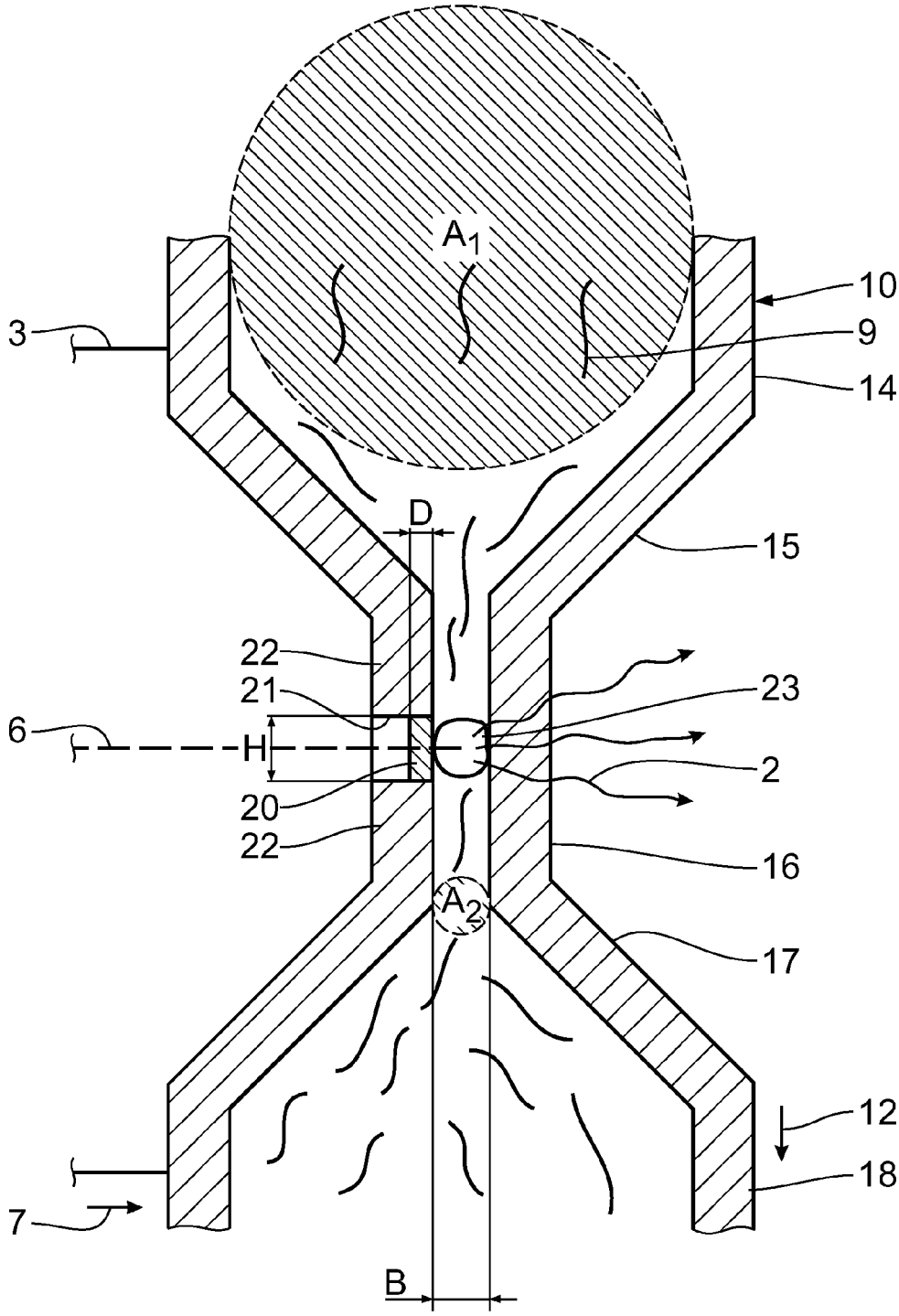
FIG. 2 is a schematic illustration of the liquid line in the region of an entrance window for an electron beam.

In the supply portion 14 and in the discharge portion 18, the liquid line 10 has a first inner cross-sectional surface $A_1$. Correspondingly, the liquid line 10 has a second inner cross-sectional surface $A_2$ in the impingement portion 16 comprising the entrance window 20. The inner cross-sectional surfaces $A_1$ and $A_2$ are outlined in FIG. 2. Seen in the direction of an inside of the liquid line 10, the entrance window 20 is flush with the line wall 22 so that the second inner cross-sectional surface $A_2$ is constant in the entire impingement portion 16. The ratio $A_1/A_2$ of the first inner cross-sectional surface $A_1$ to the second inner cross-sectional surface $A_2$ is greater than 1, in particular greater than 10, and in particular greater than 100. Bernoulli's equation states that the greater the ratio $A_1/A_2$, the lower the static pressure applied by the liquid 9 to the entrance window 20 in a radially outward direction. Along the electron beam direction 7, the impingement portion 16 has an internal dimension B of no more than 5000 μm, in particular of no more than 1000 μm, and in particular of no more than 100 μm. The smaller the internal dimension B, the smaller the interaction zone 23, resulting in an improved image quality of the X-ray images generable by means of the X-radiation.

In order to achieve a high generation efficiency of X-radiation 2 compared to the generation of heat, the liquid 9 consists of a material of at least one chemical element, the at least one chemical element having an atomic number of at least 50. If the liquid 9 consists of a material of several chemical elements, then each chemical element has an atomic number of at least 50. The material of the liquid 9 is preferably mercury. The generation efficiency of X-radiation 2 compared to the generation of heat increases linearly with the atomic number of the material of the liquid 9.

The radiation source 1 is surrounded by a lead shield 24 which is only outlined in FIG. 1. The lead shield 24 comprises an exit window 25 for the generated X-radiation 2 in the region of the impingement portion 16. The radiation source 1 is for example part of an X-ray computer tomograph for non-destructive examination of industrial objects.

The following is a description of the generation of X-radiation 2 by means of the radiation source 1. The electron beam generation unit 5 is used to generate electrons by thermionic emission which are then accelerated by the acceleration voltage $U_B$ so as to form the electron beam 6. The electron beam 6 extends through the chamber 3 in the electron beam direction 7 and hits the liquid line 10 in the impingement portion 16. The entrance window 20 is substantially permeable to the electrons of the electron beam 6, allowing the electron beam 6 to enter the liquid 9 via the liquid line 10. In the interaction zone 23, the electron beam 6 and the liquid 9 interact in the usual manner, causing X-radiation 2 to be generated which is emitted substantially in the electron beam direction 7 and exits the radiation source 1 via the exit window 25. Since the entrance window 20 is permeable and has a small dimension D in the electron beam direction 7, the electrons of the electron beam 6 lose virtually none of their kinetic energy when entering the liquid line 10. The second inner cross-sectional surface $A_2$ being considerably smaller than the first inner cross-sectional surface $A_1$ minimizes the pressure difference between the liquid 9 and the chamber 3 at the site of the entrance window 20. Moreover, the entrance window 20 is no greater than the diameter of the electron beam 6, thus ensuring a high stability of the liquid line 10 in the impingement portion 16.

The liquid 9 is continuously pumped through the liquid line 10 by means of the liquid pump 13, causing the heat generated in the interaction zone 23 to be dissipated by an exchange of the liquid 9 in the interaction zone 23. The liquid 9 heated in the interaction zone 23 is pumped through the cooling unit 19 by means of the liquid pump 13, causing the supplied heat to be dissipated again so that the liquid 9 does not have an increased temperature when recirculating through the interaction zone 23. The liquid 9 is completely surrounded by the liquid line 10 in the direction of the chamber 3, thus preventing liquid 9 from evaporating in the interaction zone 23 and escaping the liquid line 10. This ensures full functionality and high reliability of the radiation source 1. The pressure of the liquid 9 and the flow speed of the liquid 9 may be adjusted by means of the liquid pump 13. The funnel-shaped taper of the first transition portion 15 in the flow direction 12 ensures a laminar flow at the transition between the supply portion 14 and the impingement portion 16.

The continuous exchange of the liquid 9 in the interaction zone 23 and circulation thereof in the liquid line 10 prevents thermal destruction of the liquid 9 acting as X-ray target. The dissipation of heat from the interaction zone 23 is improved compared to solid bodies, enabling an increased output power of the X-radiation 2 to be achieved. Moreover, the size of the interaction zone 23, i.e. the size of the focal spot, may be influenced by appropriately selecting the dimension H of the entrance window 20 and the internal dimension B of the impingement portion 16. Accordingly, this allows a small size of the focal spot to be achieved, thus providing for a high image quality of the X-ray images generated by means of the X-radiation 2. In particular, this allows typical problems to be avoided when examining objects with high penetration lengths and/or objects made of high-absorption materials, such as blurred edges, reduced visibility of details and increased error detection limits for inclusions.

Due to the high acceleration voltage $U_B$, the liquid 9 acts as a transmission X-ray target, causing the generated X-radiation 2 to be emitted substantially in the electron beam direction 7. This is extremely efficient considering the fact that the intensity relationship of X-radiation 2 generated in the electron beam direction 7 compared to X-radiation 2 generated opposite to the electron beam direction 7 increases with increasing acceleration voltage $U_B$. At acceleration voltages $U_B$ from approximately 1 MV, substantially the entire X-radiation 2 is generated in the electron beam direction 7. At least on the side opposite to the entrance window 20, i.e. for instance in the entire impingement portion 16, the line wall 22 is designed in such a way that the generated X-radiation 2 is able to exit the liquid line 10 substantially unattenuated in the electron beam direction 7.

While a specific embodiment of the invention have been described in detail to illustrate the application of the principles of the invention, it will be understood that the invention may be embodied otherwise without departing from such principles.

The invention claimed is:

1. A radiation source for the generation of high-energy X-radiation, the radiation source comprising:

an evacuated chamber;

an electron beam generation unit for the generation of an electron beam extending in the chamber in an electron beam direction, said electronic beam generation unit being operable at an acceleration voltage of at least 3 MV;

a target unit, the target unit comprising a liquid line with a liquid arranged therein, the liquid line extending transversely to the electron beam direction, wherein an interaction zone for the generation of X-radiation is generable by interaction of the electron beam and the liquid, the liquid being completely surrounded by the liquid line in the direction of the chamber, at least a portion of the liquid line being permeable to the electron beam in such a way that the interaction zone is generable inside the liquid line, said permeable portion of the liquid line having a dimension in a range of 50 μm to 500 μm in the electron beam direction and a dimension in a direction transverse to the electron beam direction of no more than 1000 μm, said target unit being designed such that the X-radiation is emissible substantially in the electron beam direction.

2. A radiation source according to claim 1, wherein the permeable portion of the liquid line consists of a material of one chemical element having an atomic number of no more than 14.

3. A radiation source according to claim 2, wherein the material is at least one of the group comprising beryllium, diamond and aluminum.

4. A radiation source according to claim 1, wherein the permeable portion is an entrance window which is tightly arranged in a recess of a line wall of the liquid line.

5. A radiation source according to claim 1, wherein the liquid line comprises a supply portion having a first inner cross-sectional surface and an impingement portion having a second inner cross-sectional surface, the impingement portion comprising the permeable portion of the liquid line, with a relationship of first inner cross-sectional surface to second inner cross-sectional surface being greater than 1.

6. A radiation source according to claim 5, wherein a transition portion extending in the shape of a funnel is formed between the supply portion and the impingement portion.

7. A radiation source according to claim 1, wherein the liquid line comprises an impingement portion having an internal dimension of no more than 5000 μm along the electron beam direction.

8. A radiation source according to claim 1, wherein the target unit comprises a liquid pump.

9. A radiation source according to claim 1, wherein the target unit comprises a cooling unit for cooling the liquid.

10. A radiation source according to claim 1, wherein the liquid consists of a material of one chemical element having an atomic number of at least 50.

11. An X-ray computer tomograph comprising:

a radiation source for generating high-energy X-radiation, said radiation source comprising:

an evacuated chamber;

an electron beam generation unit for the generation of an electron beam extending in the chamber in an electron beam direction;

a target unit, the target unit comprising a liquid line with a liquid arranged therein, the liquid line extending transversely to the electron beam direction, said target unit comprising an interaction zone for the generation of X-radiation being generable by interaction of the electron beam and the liquid, wherein the liquid is completely surrounded by the liquid line in the direction of the chamber, at least a portion of the liquid line being permeable to the electron beam in such a way that the interaction zone is generable inside the liquid line, said electronic beam generation unit being operable at an acceleration voltage of at least 3 MV, said permeable portion of said liquid line having a dimension in a range of 50 μm to 500 μm in the electron beam direction and a dimension in a direction transverse to said electron beam direction of no more than 1000 μm, said target unit being designed such that the X-radiation is emissible substantially in the electron beam direction.

12. A method for the generation of high-energy X-radiation, the method comprising the following steps:

generating an electron beam extending in an evacuated chamber in an electron beam direction via an electron beam generation unit which is operated at an acceleration voltage of at least 3 MV;

guiding a liquid, which is completely surrounded by a liquid line in the direction of the chamber, through the chamber in a direction transverse to the electron beam direction;

introducing the electron beam into the liquid via at least one portion of the liquid line which is permeable to the electron beam, said permeable portion of said liquid line having a dimension in a range of 50 μm to 500 μm in said electron beam direction and a dimension of no more than 1000 μm in a direction transverse to said electron beam direction; and generating an interaction zone inside the liquid line where the electron beam interacts with the liquid for the generation of high-energy X-radiation, said X-radiation being emitted substantially in said electron beam direction.

13. A radiation source according to claim 1, wherein the permeable portion of the liquid line consists of a material of several chemical elements each having an atomic number of no more than 14.

14. A radiation source according to claim 1, wherein the permeable portion of the liquid line has a dimension in a direction transverse to the electron beam direction of no more than 500 μm.

15. A radiation source according to claim 1, wherein the liquid line comprises a supply portion having a first inner cross-sectional surface and an impingement portion having a second inner cross-sectional surface, the impingement portion comprising the permeable portion of the liquid line, with a relationship of first inner cross-sectional surface to second inner cross-sectional surface being greater than 10.

16. A radiation source according to claim 1, wherein the liquid line comprises a supply portion having a first inner cross-sectional surface and an impingement portion having a second inner cross-sectional surface, the impingement portion comprising the permeable portion of the liquid line, with a relationship of first inner cross-sectional surface to second inner cross-sectional surface being greater than 100.

17. A radiation source according to claim 1, wherein the liquid line comprises an impingement portion having an internal dimension of no more than 1000 μm along the electron beam direction.

18. A radiation source according to claim 1, wherein the liquid line comprises an impingement portion having an internal dimension of no more than 100 μm along the electron beam direction.

19. A radiation source according to claim 1, wherein the liquid consists of a material of several chemical elements each having an atomic number of at least 50.

* * * * *